United States Patent [19]

Buschow

[11] Patent Number: 4,897,130

[45] Date of Patent: Jan. 30, 1990

[54] MAGNETIC MATERIAL COMPRISING AN INTERMETALLIC COMPOUND OF THE RARE EARTH TRANSITION METAL TYPE

[75] Inventor: Kurt H. J. Buschow, Eindhoven, Netherlands

[73] Assignee: U.S. Philips Corporation, New York, N.Y.

[21] Appl. No.: 262,569

[22] Filed: Oct. 24, 1988

Related U.S. Application Data

[63] Continuation-in-part of Ser. No. 57,722, Jun. 2, 1987, abandoned, which is a continuation of Ser. No. 824,992, Feb. 3, 1986, abandoned.

[30] Foreign Application Priority Data

Feb. 21, 1986 [EP] European Pat. Off. ..... 86200267.2

[51] Int. Cl.[4] ..... H01F 1/04

[52] U.S. Cl. ..... 148/302; 420/435

[58] Field of Search ..... 148/302; 420/435

[56] References Cited

U.S. PATENT DOCUMENTS 4,541,877 9/1985 Stadelmaier et al. ..... 148/101

4,663,066 5/1987 Fruchart et al. ..... 252/62.51

FOREIGN PATENT DOCUMENTS 0106948 5/1984 European Pat. Off. .

OTHER PUBLICATIONS

Herbst et al, "Relationship Between Crystal Structure and Magnetic Properties in $Nd_2Fe_{14}B$," Phy. Rev. B, vol. 29, No. 7, Apr. 1, 1984, pp. 4176–4178.

*Primary Examiner*—John P. Sheehan

*Attorney, Agent, or Firm*—Norman N. Spain

[57] ABSTRACT

A permanent magnetic material having a main phase of the $R_2(Co_{1-x}Fe_x)_{14}B$ type in which R represents Nd, Pr and/or Tb, or a combination of one of these with at least one other member of the group of rare earth metals and Y, and in which $O \leqq x \leqq 0.2$. Magnets can be produced of this material by means of a powder-metallurgic process resulting in magnets having a combination of a high $T_c$ and a high $_IH_c$.

4 Claims, 4 Drawing Sheets

MAGNETIC MATERIAL COMPRISING AN INTERMETALLIC COMPOUND OF THE RARE EARTH TRANSITION METAL TYPE

This application is a continuation of application Ser. No. 057,722, filed June 2, 1987, now abandoned which in turn is a continuation of application Ser. No. 824,992, filed Feb. 3, 1986, now abandoned.

BACKGROUND OF THE INVENTION

The invention relates to a magnetic material in which the main phase is formed by an intermetallic compound of the rare earth transition metal type.

Magnetic materials based on intermetallic compounds of certain rare earth metals with transition metals (RE-TM) may be formed into permanent magnets having coercive forces of considerable magnitude (several kOe). The magnetic materials in question are for this purpose ground to particles having a subcrystalline size and then aligned in a magnetic field. The alignment of the particles and hence the magnetic orientation is then fixed by sintering or by immersing the particles in a (synthetic material) binder or in a low-melting-point metal such as lead. These methods are referred to as powder-metallurgic methods of manufacturing rare earth metal-transition metal magnets. In such a treatment these intermetallic compounds develop unusually high intrinsic coercive forces at room temperature.

The most commonly known intermetallic compounds which can be processed into magnets by powder metallurgy contain essentially quantities of samarium and cobalt, for example, single-phase $SmCo_5$ and multiphase $SmCo_z$ in which $z \approx 7$. Item 1. Permanent magnets based on single-phase $SmCo_5$ are currently produced in large quantities. The energy products are of the order of 20 MG Oe. Permanent magnets based on multiphase $SmCo_z$ in which $z \approx 7$ and in which Co is partly replaced by Fe and Cu have higher energy products (27 MG Oe). Preparation of this class of magnets is, however, extremely difficult and complicated.

The most recently devised types of rare earth transition metal magnets are based on ternary compounds of the type $R_2Fe_{14}B$ (R=Nd, Pr), which have still higher energy products of approximately 35 Mg Oe. The preparation of these magnets can be compared with that described under item 1, that is to say, the preparation is simpler than that of multiphase $SmCo_z$ magnets described under item 2. A drawback of the $R_2Fe_{14}B$ magnet is the low Curie temperature ($T_c$=307° C.) and the attendant high negative temperature coefficient of the magnetization $\sigma$ and of the coercive force $H_c$. This drawback may be partly removed by Co substitution. This has been described in EP-A 106,948.

However, the above-mentioned publication states that when substituting Fe by Co, the coercive force starts to decrease from the situation in which 25% of Fe is substituted by Co and that not more than 50% of Fe should be substituted by Co in order to produce a material having a coercive force of 80 kA/m or more, which is that required for a magnet to be of use in practice. Consequently, the advantage of the rise in Curie temperature by substitution of Co is usable only to a limited extent.

SUMMARY OF THE INVENTION

It is an object of the invention to provide a new magnetic material which can be used in practice and is based on an intermetallic compound of the rare earth transition metal type having an energy product which is at least as high as that of multiphase $SmCo_z$ and which can be prepared in a simpler manner than materials based on multiphase $SmCo_z$ and has a higher Curie temperature than $R_2Fe_{14}B$ in which less than 50% of Fe is substituted by Co.

To achieve this the magnetic material described in the opening paragraph is characterized in that the intermetallic compound has a composition defined by the formula $$R_2(Co_{1-x}Fe_x)_{14}B$$

in which $0 \leqq x \leqq 0.2$ and R=Nd, Pr and/or Tb or a combination of one of these with at least one other member of the group of rare earth metals and Y.

It has been found that in intermetallic compounds of the type $R_2(Co_{1-x}Fe_x)_{14}B$ in which $0 \leqq x \leqq 0.2$, the coercive force increases as the Co content increases, and this also applies to the Curie temperature. If R=Y, Nd, Pr, La, Sm, Gd or Tb, solely or in combination with at least one member of the group of rare earth metals and Y, a tetragonal crystal structure is formed.

DETAILED DESCRIPTION OF THE INVENTION

Figure 1:
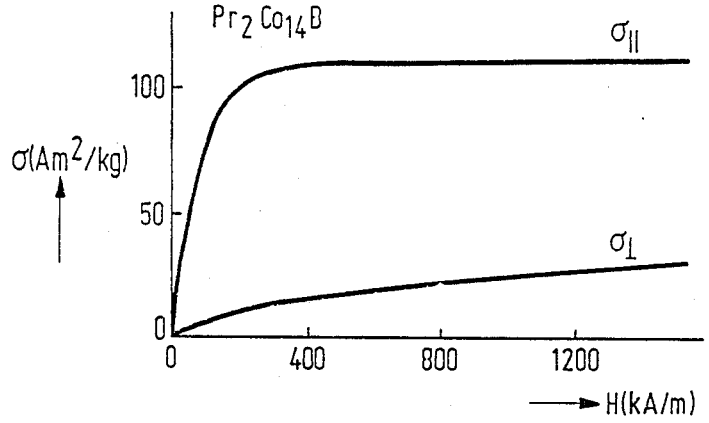
FIG. 1 is a graph showing the magnetization $\sigma$ of a $Pr_2Co_{14}B$ sample as a function of the strength of an applied field H (measurements at 300K).
Figure 2:
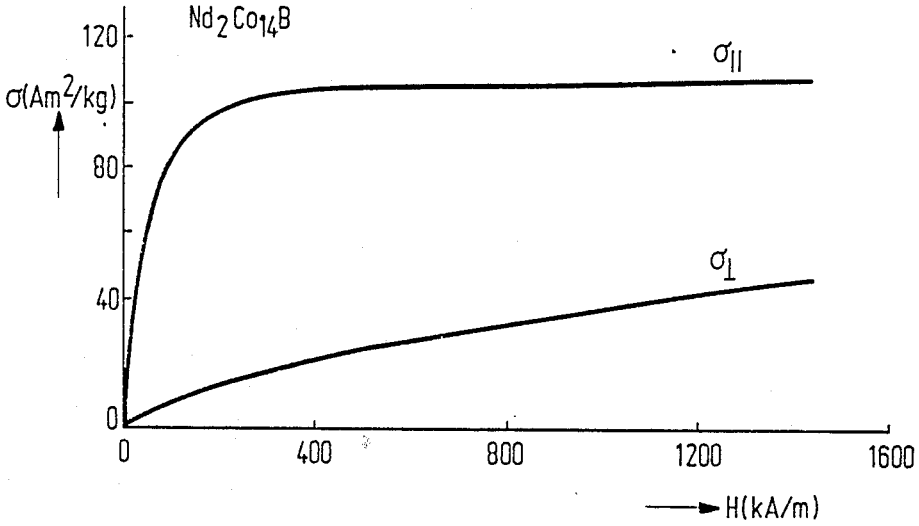
FIG. 2 is a graph showing the magnetization $\sigma$ of an $Nd_2Co_{14}B$ sample as a function of the strength of an applied field H (measurements at 300K).

A preferred embodiment of the invention is characterized in that the intermetallic compounds has a composition defined by the formula $R_2(Co_{1-x}Fe_x)_{14}B$ in which $0 \leqq x \leqq 0.1$. This system has a lower Fe content, which is advantageous with respect to corrosion resistance.

A special embodiment of the invention is characterized in that the intermetallic compound has a composition defined by the formula $$R_2Co_{14}B.$$

The intermetallic compounds of this formula exhibit the highest values of the coercive force, while having a maximum corrosion resistance due to the absence of iron.

Within the $R_2(Co_{1-x}Fe_x)B$ formula $Pr_2(Co_{1-x}Fe_x)B$ and $Nd_2(Co_{1-x}Fe_x)B$ are preferred in connection with their high magnetization values.

The magnetic material is preferably manufactured by pulverizing a casting which, after melting, is subjected to an annealing treatment in an oxidation-preventive atmosphere at a temperature of more than 800° C. This ensures that as much as possible of the tetragonal main phase and a minimum of other, undesired, phases are present.

The magnetic material according to the invention is preferably used in the form of a sintered magnet. Such sintered magnet is prepared from the above-mentioned annealing treated magnetic material by means of the following steps: pulverizing said material, aligning the pulverized material and pressing it into a desired magnet form, sintering said form during 2 hours at 1000°-1300° C. in an argon atmosphere. In this form the highest energy product can be realized.

Calculations based on anisotropic field measurements have shown that the maximum energy product $(BH)_{max}$ of sintered $R_2(Co_{1-x}Fe_x)_{14}B$ permanent magnets may be in the region of 30 Mg Oe.

The invention will now be described in greater detail with reference to the drawing and the following examples and experiments.

For preparing a plurality of samples, 99.9% pure starting materials were used which were melted under an argon arc in purified argon gas. After melting and subsequently cooling, the samples were wrapped in tantalum foil and subjected to an annealing treatment at a temperature of 900° C. in an evacuated quartz tube. The samples were then ground. The resulting powder particles were magnetically aligned in a magnetic field and ground by means of an epoxy resin. A plurality of measurements was performed on the magnetic members obtained in this manner. The results of these measurements are given in Table 1.

TABLE 1

| $R_2Co_{14}B$ | $T_c$ (K) | $\sigma_s$ ($am^2/kg$) | EMD |
|---|---|---|---|
| R = Y | 1015 | 107 | ⊥C |
| La | 955 | 102 | ⊥C |
| Pr | 995 | 124 | ‖C |
| Nd | 1007 | 126 | ‖C |
| Sm | 1029 | 89 | ⊥C |
| Gd | 1050 | 32 | ⊥C |
| Tb | 1035 | 10 | ‖C |

In the table $T_c$ is the Curie temperature. The Curie temperature of $Nd_2Fe_8Co_6B$: −880 K. ($Nd_2Co_{14}B$: $T_c$=1007 K.) serves for comparison. $\delta_s$ is the saturation magnetization and EMD is the direction of easy magnetization. $\delta_s$ is derived from measurements of the magnetization at 4.2K in magnetic fields to 35 T. The easy magnetization direction (EMD) is given relative to the c-axis.

Figure 7:
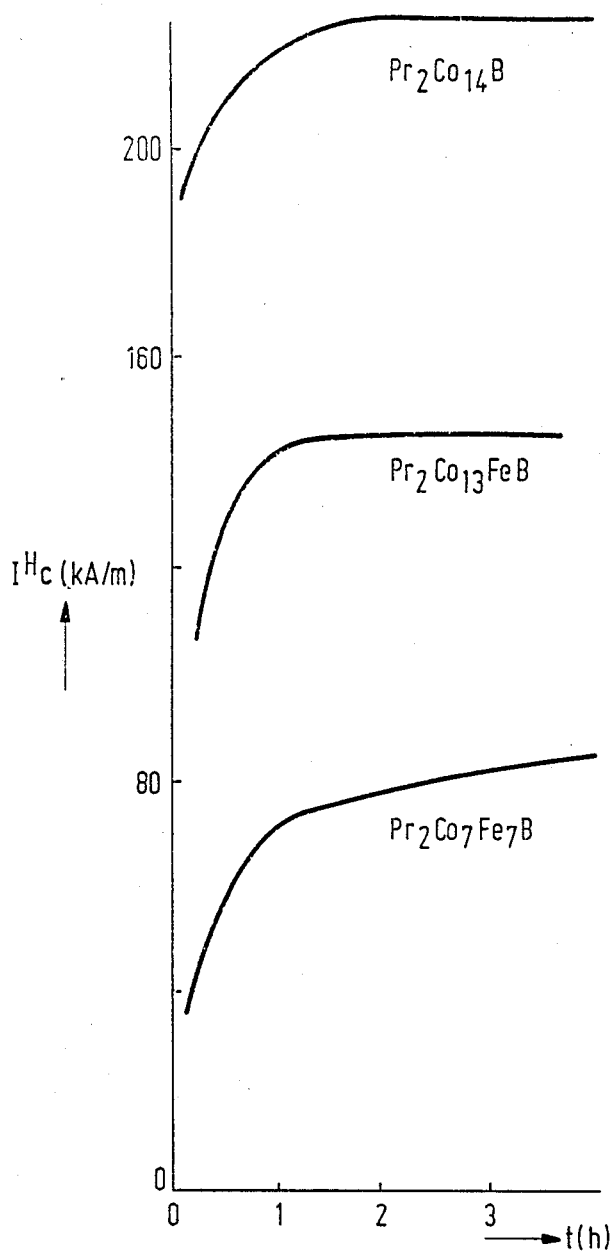
FIG. 7 is a graph showing the coercive force $I^H{}_c$ as a function of the grinding time t of a $Pr_2Co_7Fe_7B$ magnet, a $Pr_2CO_{13}FeB$ magnet and a $Pr_2Co_{14}B$ magnet, respectively.

The anisotropic field of single-phase $Pr_2Co_{14}B$ at room temperature is extremely high (of the order of 100 kOe, see FIG. 1). The saturation magnetization at room temperature is also high (110 $Am_2/kg$). Reasonably large values of the coercive force ${}_IH_c$ can even be provided by grinding in a manually operated agate mortar (FIG. 7). The estimated values for $BH_{max}$ for sintered magnets of single-phase $Pr_2Co_{14}B$ are around 30 MG Oe. This estimation is based on a density of 8.4 g/cm$^3$ calculated by means of the lattice constants a=8.63 Å, c=11.87 Å.

The values of the Curie temperature $T_c$ were determined by means of calorimetric measurements.

Figure 5:
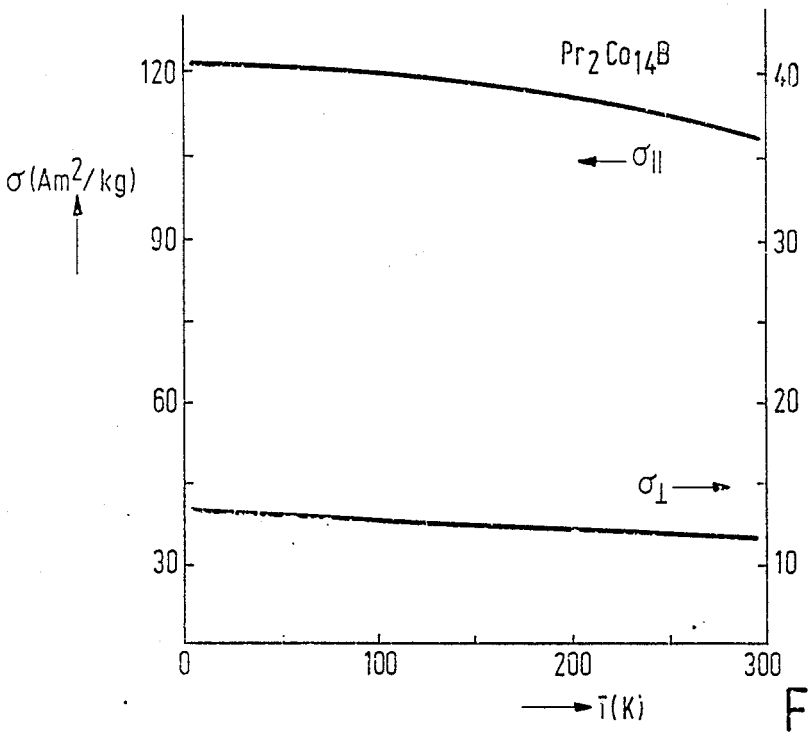
FIG. 5 is a graph showing the magnetization $\sigma$ of a $Pr_2Co_{14}B$ sample as a function of the temperature T (B=0.3 T).
Figure 6:
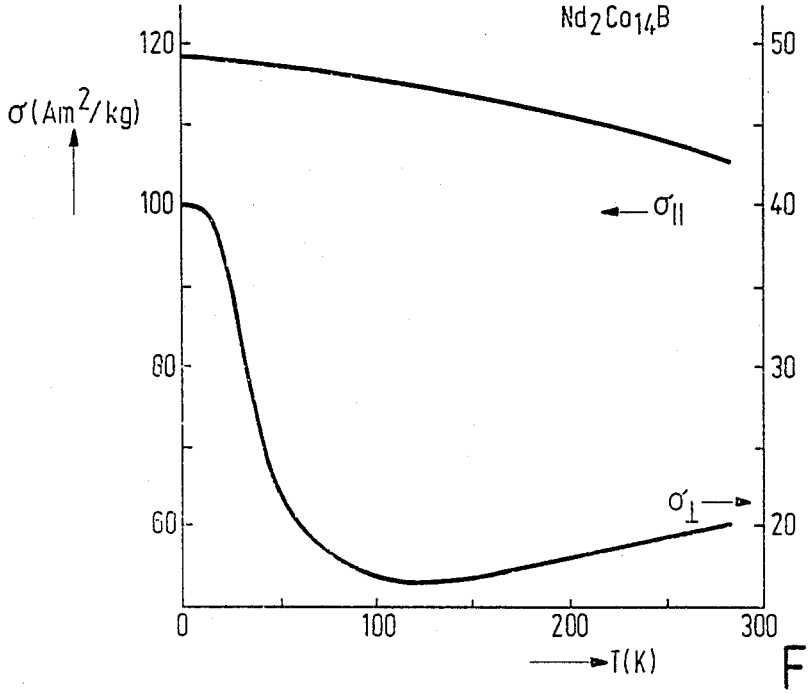

Measurements of the temperature dependence of $\delta$ below $T_c$ are shown in FIGS. 5 and 6. The results shown relate to $Pr_2Co_{14}B$ (FIG. 5) and $Nd_2Co_{14}B$ (FIG. 6). These results are characteristic of intermetallic compounds of the type according to the invention.

The measurements whose results are shown in FIGS. 1, 2, 3, 5 and 6 were performed with an applied field H which was either parallel to the direction of the magnetic field ($\delta$ ‖) used during alignment, or was at right angles to the direction of the magnetic field ($\sigma\perp$) used during alignment.

Figure 3:
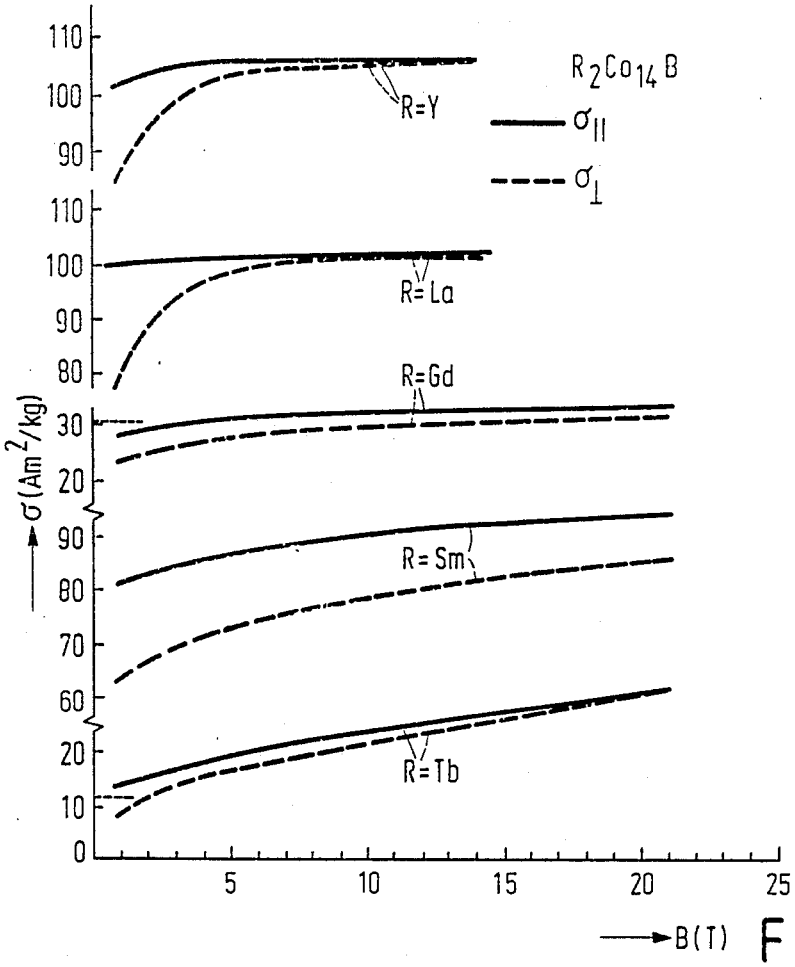
FIG. 3 is a graph showing the magnetization $\sigma$ of a plurality of $R_2Co_{14}B$ samples as a function of the strength of an applied field H (measurements at 4.2K).
Figure 4:
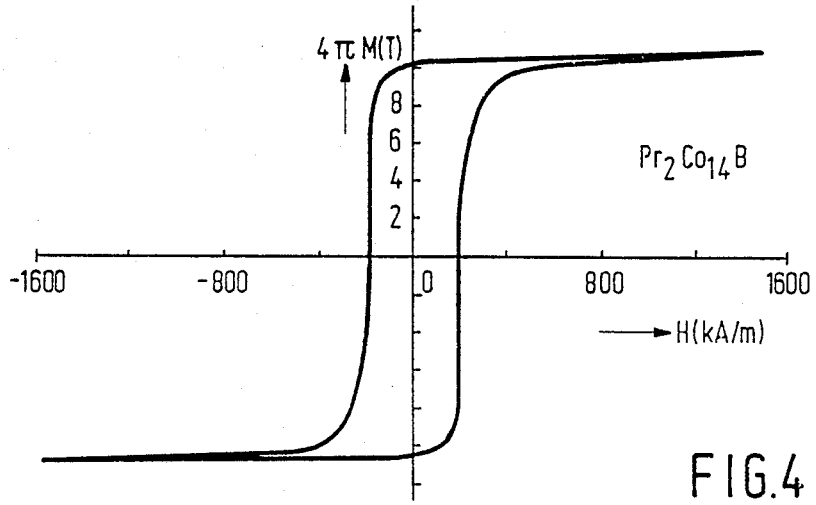
FIG. 4 is a graph showing the $4\pi$M-H characteristic of a $Pr_2Co_{14}B$ magnet.

The anisotropic field could be calculated by extrapolating the results of the magnetization measurements at 4.2° K. in high magnetic fields. This field is very high for $Pr_2Co_{11}B$ (~75 T), for $Nd_2Co_{14}B$ it is approximately 40 T. FIG. 3 shows that the anisotropic fields of $Y_2Co_{14}B$ and $La_2Co_{14}$ are considerably lower and have a value of approximately 5 T.

A tetragonal crystal structure corresponding to that of $Nd_2Fe_{14}B$ is found for the intermetallic compounds of the $R_2Co_{14}B$ type in cases where R contains La, Pr, Nd, Sm, Gd or Tb. A tetragonal crystal structure was also found in cases were R contained one of these rare earth metals together with another rare earth metal. For example, in the case where $R=(La_{1-y}Er_y)$ in which y=0.1 and in the case where $R=(La_{1-y}Dy_y)$ in which y=0.2.

What is claimed is:

1. A sintered magnetic material consisting essentially of a rare-earth transition metal intermetallic compound having a composition defined by the formula $$R_2(Co_{1-x}Fe_x)_{14}B$$

where $0 \leqq x \leqq 0.2$, and R is at least one element selected from the group consisting of Nd, Pr, and Tb, with or without one or more of a member of the group consisting of Y and other rare-earth metals, the maximum energy product of the magnetic material being about 30 megagauss-oersted.

2. A magnetic material as claimed in claim 1, characterized in that $0 \leqq x \leqq 0.1$.

3. A magnetic material as claimed in claim 2, characterized in that the intermetallic compound has a composition defined by the formula $$R_2Co_{14}B.$$

4. A magnetic material as claimed in claim 3, characterized in that R is Pr and/or Nd.

* * * * *